US007866613B2

(12) United States Patent
Cramer

(10) Patent No.: US 7,866,613 B2
(45) Date of Patent: Jan. 11, 2011

(54) APPARATUS FOR MOUNTING A WHEELCHAIR ARM PAD

(75) Inventor: David Cramer, Hartford, WI (US)

(73) Assignee: The Comfort Companies, Inc., Bozeman, MT (US)

( * ) Notice: Subject to any disclaimer, the term of this patent is extended or adjusted under 35 U.S.C. 154(b) by 187 days.

(21) Appl. No.: 12/042,278

(22) Filed: Mar. 4, 2008

(65) Prior Publication Data

US 2009/0224121 A1 Sep. 10, 2009

(51) Int. Cl.
*B68G 5/00* (2006.01)

(52) U.S. Cl. ..... 248/118; 248/285.1; 248/292.12; 248/230.1; 297/411.36

(58) Field of Classification Search ..... 248/118, 248/118.3, 279.1, 214, 285.1, 286.1, 292.12; 297/411.36, 411.35
See application file for complete search history.

(56) References Cited

U.S. PATENT DOCUMENTS 1,403,863 A * 1/1922 Peat ..... 248/219.4
1,516,795 A * 11/1924 Schwarting ..... 5/646
2,982,344 A * 5/1961 Berlin ..... 297/188.12
3,627,244 A * 12/1971 Nicholas ..... 248/103
4,576,351 A * 3/1986 Brink ..... 248/118
5,135,109 A * 8/1992 Vergara ..... 206/386
5,462,247 A * 10/1995 Aldrich ..... 248/118
5,522,644 A * 6/1996 Peek ..... 297/423.26
5,964,439 A * 10/1999 Johnson ..... 248/278.1
6,203,109 B1 * 3/2001 Bergsten et al. ..... 297/411.35
6,786,461 B1 * 9/2004 Tsai et al. ..... 248/118.3
2005/0052066 A1 * 3/2005 Wright ..... 297/411.36

* cited by examiner

*Primary Examiner*—Anita M King
(74) *Attorney, Agent, or Firm*—Joseph S. Heino; Patrick M. Bergin

(57) ABSTRACT

The claimed invention provides an apparatus and system for mounting a wheelchair arm pad to a wheelchair that provides a high degree of support and adjustability such that it can be used with wheelchairs from a wide variety of different manufacturers. In order to provide this custom fit, the claimed invention provides for a single point mounting system having elevation, articulation, depth, and width adjustability.

14 Claims, 14 Drawing Sheets

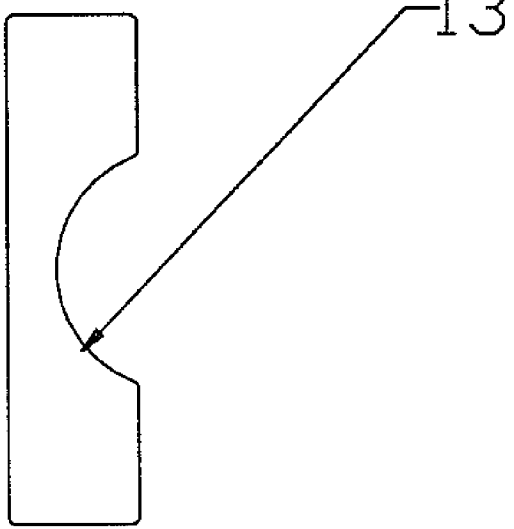
FIG. 2B
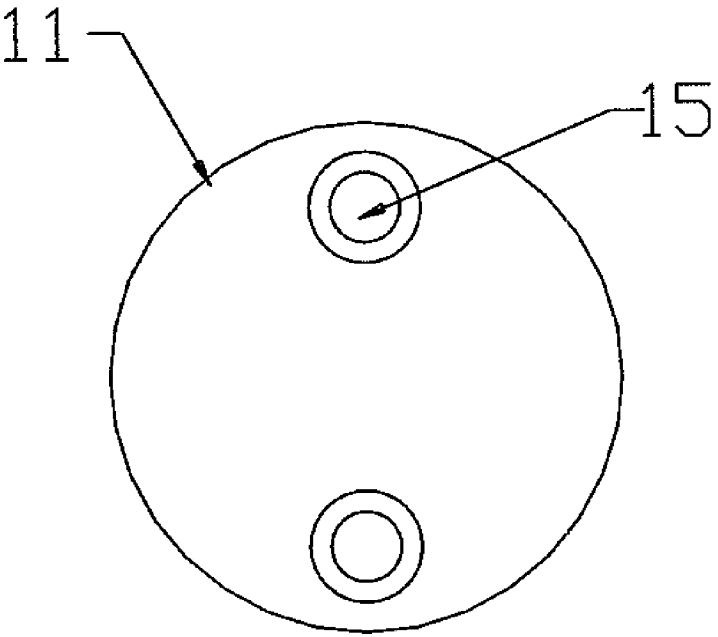
FIG. 2A
FIG. 2

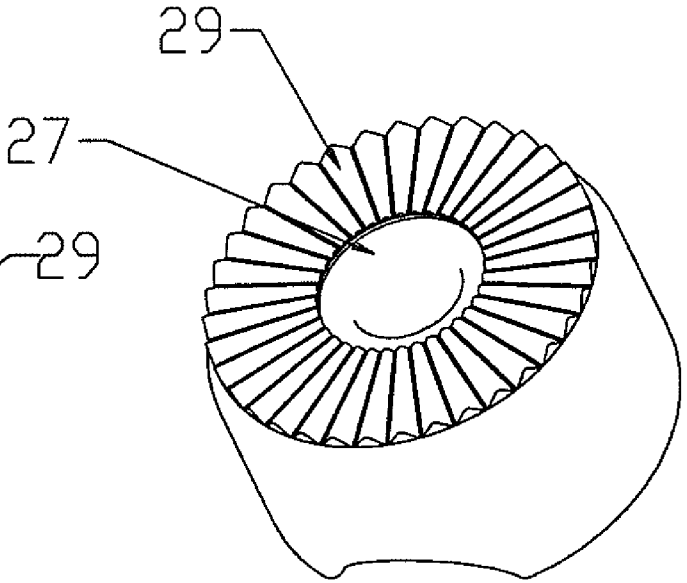
FIG. 3C
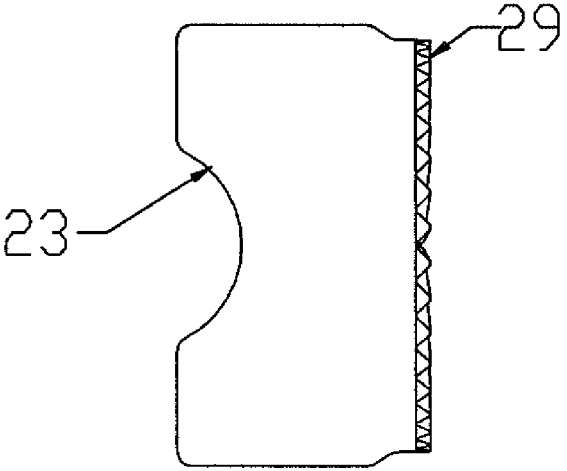
FIG. 3B
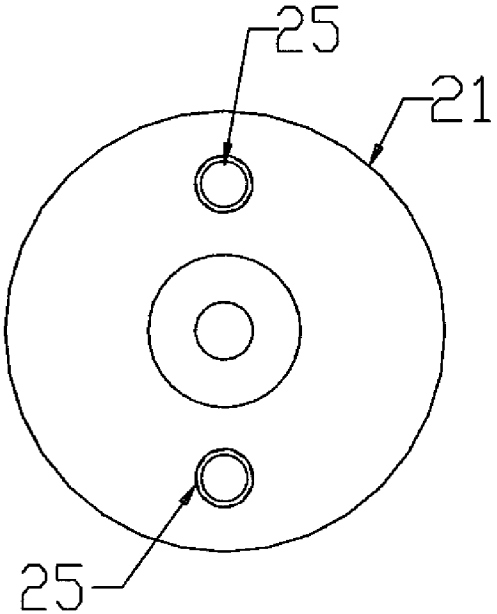
FIG. 3A
FIG. 3

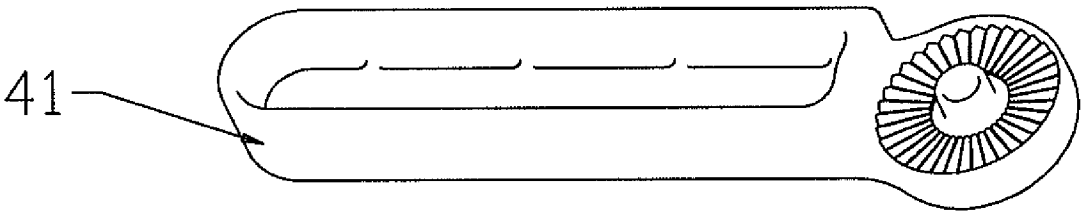
FIG. 4A
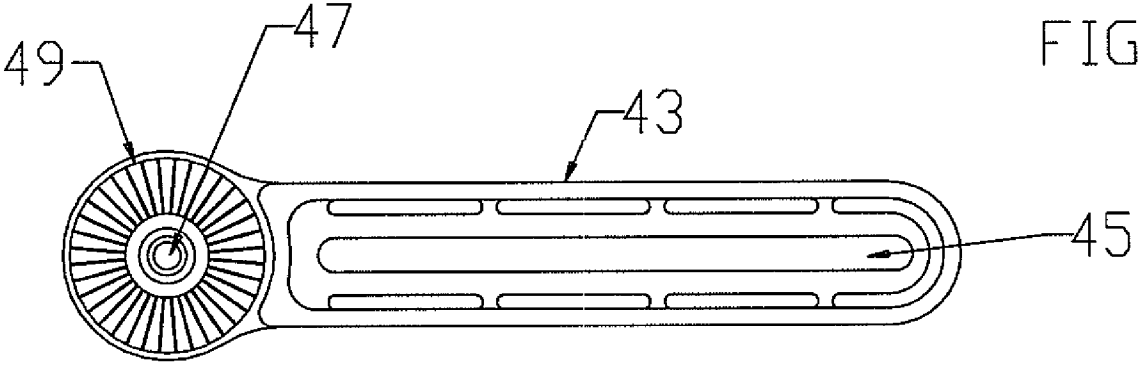
FIG. 4B
FIG. 4

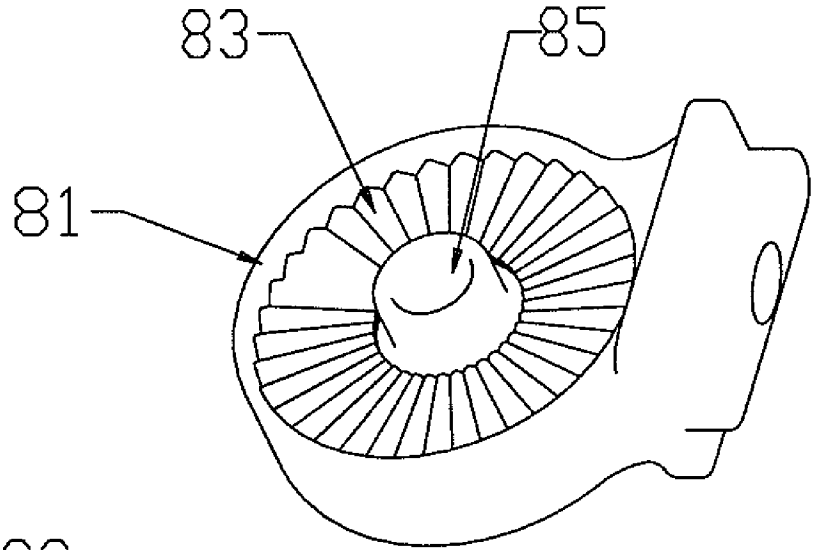
FIG. 5B
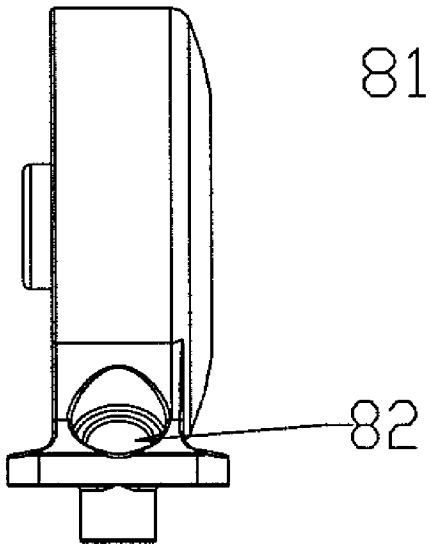
FIG. 5A
FIG. 5

APPARATUS FOR MOUNTING A WHEELCHAIR ARM PAD

FIELD OF THE INVENTION

The present invention relates generally to wheelchairs and more specifically to adjustable wheelchair arm pads. In even more detail, the present invention relates to an apparatus and system for mounting a wheelchair arm pad to the horizontal or vertical tube of a wheelchair armrest that provides adjustability in four dimensions. The mounting apparatus and system of the present invention is also adjustable so as to precisely fit a wide variety of existing wheelchairs.

BACKGROUND OF THE INVENTION

People using a wheelchair are affected by many conditions including cerebral palsy, quadriplegia, paraplegia, stroke, kyphosis, scoliosis, old age, multiple sclerosis and head injuries, among other debilitating physical conditions. These individuals often suffer from edema (pooling of fluid in areas of poor vascular flow), loss of memory, subluxation of the shoulder, trunk control, limited range of motion, and many safety concerns.

One of the most common complaints of wheelchair occupants is that of pain that is directly related to their use of a wheelchair. Unfortunately, at least some of the problems faced by wheelchair users are further exacerbated by the failure of current designs of wheelchair armrest pads and armrest pad systems to properly position a wheelchair occupant. An armrest pad that can be adjusted to meet the individual needs of people that have a variety of disabilities is needed.

For example, some stroke patients need to have an armrest pad adjusted to maintain the correct pressure on the shoulder joint to prevent subluxation of the humeral head, which can lead to irreversible damage and shoulder pain. Stroke patients may need their arm to be in their field of view as a cognitive reminder of its existence, which can help prevent them from hitting their arm on door frames or from falling into the wheels of a wheelchair. Depending on the user's post-stroke stage, whether flaccid or spastic, a properly adjusted armrest will help maintain shoulder integrity and prevent the spine from flexing laterally by compensating for loss of righting muscles.

Proper arm support also improves shoulder girdle stability. Stability of the shoulder girdle allows for an upright trunk which facilitates an upright and vertical head position. Armrests can help many cerebral palsy patients and others without trunk and head control perform activities of daily living. For example, it is very difficult to maintain one's head in the correct position, as it is a large mass connected with a series of intricate structural and muscular systems. When a person has any type of structural, muscular or nervous system disability, frequently, proper head position is difficult to maintain, which can cause further health problems. Maintaining proper shoulder girdle alignment is the first step to maintaining proper head alignment.

Proper positioning of an armrest can also help maintain upper extremity range of motion and prevent contracture. Many quadriplegic, paraplegic, and other disabled patients may have limited or no use of their arms and shoulders. An armrest can help prevent contracture, that is, prevent the muscles in the arm and hand from contracting. It is imperative to treat patients at risk of contracture early and to maintain a regimented schedule of therapy. Once the arm is in contracture, it is difficult to restore the arm to a "normal" position.

An additional problem exists relative to hand position. An open hand position is important for two reasons: hygiene and protection of the hand muscle and tissue. If the hand is permitted to close, it will often overheat and cause other hygiene issues. Additionally, it is difficult for care givers to open and clean a hand in contracture. Further, when the hand is closed tightly, finger nails will often dig into the palm thereby damaging or degrading the muscle and or tissue in the palm. Contracture and an open hand position can be controlled when the arm is properly positioned with an armrest.

Yet another problem is edema, which is pooling of the fluid in the body, often as a result of surgery or trauma. Elevating the hand above the elbow can help prevent fluid build up. However, effective edema prevention requires elevation of the entire extremity above the heart. Simply elevating the hand provides only temporary protection. In such cases, the fluid will most likely remain in the arm, not the hand, where circulation is typically better.

An additional problem users face is that of safety. Door frames and other obstacles can pose significant hazards to wheelchair users who are unable to move their arms out of harm's way during wheelchair movement.

A further problem with current wheelchair armrest systems is the variability between commercially available wheelchairs. In particular, the armrest tubes of the wheelchair, often differ in configuration between wheelchairs. Specifically, in the inventor's experience, the diameter of the wheelchair armrest tubes may vary from between ⅝" to 1.0".

Problems with existing armrests also include excessive stack height between the wheelchair armrest tube and the armrest pad. As the armrest tube height is a fixed distance, increasing that height of the armrest tube by adding a bulky mechanism increases the stack height, which, for smaller users, can raise the armrest beyond a useable range. Additionally, if the armrest hardware elevates the pad, it may push the shoulder girdle out of alignment causing structural asymmetries and potential loss of head and trunk control.

Another problem with existing armrests is the location of the axis of rotation. The axis of rotation for the elevating and articulating functions should be anatomically correct, that is, variable to accommodate the various users of wheelchairs to prevent unwanted side effects during the treatment process.

Accordingly, what is required is an arm pad and mounting apparatus that can elevate the hand about the elbow axis, articulate about the humerus axis, slide forward to accommodate varying chest trunk thicknesses, and adjust to accommodate varying chest trunk widths. The arm pad and mounting apparatus should be adjustable while the user is seated and from the outside of the wheelchair, thereby helping to protect the patient by reducing transfers into and out of the wheelchair. Providing for adjustability while the user is seated also expedites the fitting process and allows the therapist to spend more time fine tuning the fit.

Further requirements include a wheelchair armrest and mounting apparatus that is adaptable to wheelchairs having an armrest tube, having a wide variety of different diameters configurations. There is also a need to provide a wheelchair arm mounting apparatus and system that provides a wide variety of adjustability so that it can fit all shapes and sizes of people. Lastly, such an armrest mounting apparatus must help accommodate patients with a wide variety of disabilities.

SUMMARY OF THE INVENTION

The claimed invention provides an apparatus and system for mounting a wheelchair armrest that provides a high degree of support and adjustability such that it can be used with wheelchairs from a wide variety of different manufacturers. This adjustability is also beneficial to the occupant of the wheelchair, as the adjustability can provide a wide variety of people with a more custom fit. In order to provide this custom fit, the claimed invention provides for elevation, articulation, depth, and width adjustability.

The claimed mounting device and system also provides for an effective single point mounting system. Therefore, the mounting device of the present invention provides a high degree of adjustability with respect to the angle that it can be inclined or declined with respect to prior systems. Additionally, use of a single point mounting system is particularly important with wheelchairs having short armrests and other designs as it allows for a single assembly to fit the majority of wheelchair styles.

The foregoing and other features of the device and system of the present invention will be apparent from the description that follows.

BRIEF DESCRIPTION OF THE DRAWINGS

FIG. 2A is a top plan view of the armrest back clamp.

FIG. 2B is a side elevational view of the armrest back clamp.

FIG. 3A is a bottom plan view of the armrest clamp.

FIG. 3B is a side elevational view of the armrest clamp.

FIG. 3C is a side and top perspective view of the armrest clamp.

FIG. 4A is a perspective view showing the inside of the depth adjustment bracket.

FIG. 4B is an elevational view showing the inside of the depth adjustment bracket.

FIG. 5A is a side elevational view of the angle adjustment base.

FIG. 5B is a perspective view of the inside face of the angle adjustment base.

DETAILED DESCRIPTION

Figure 1:
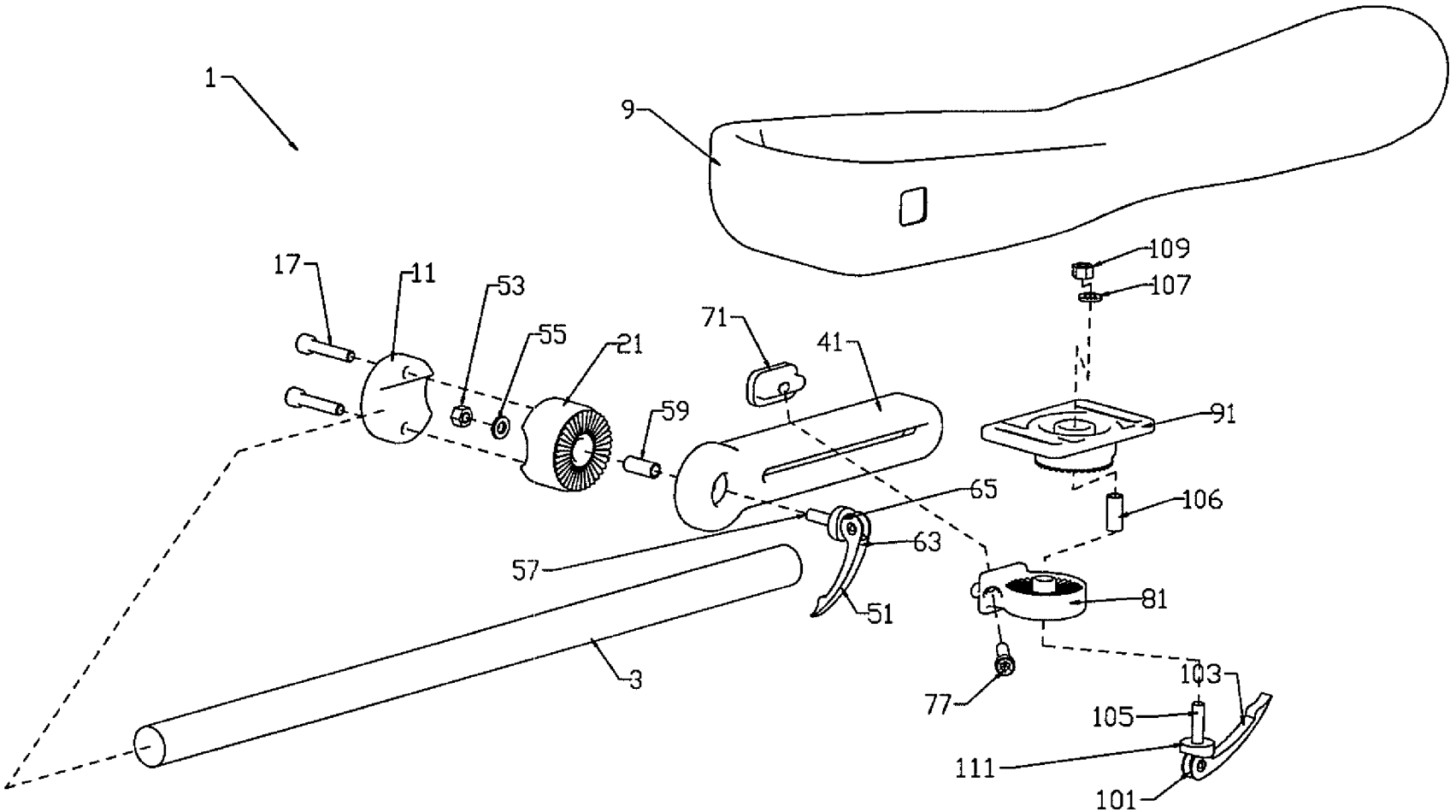
FIG. 1 is an exploded view of the apparatus for mounting a wheelchair arm pad.

Now referring to the drawings in detail wherein like reference numerals refer to like elements throughout, FIG. 1 shows an exploded view of the armrest pad 9 and the armrest attachment hardware 1 used to attach the armrest pad 9 to the wheelchair armrest tube 3.

As shown in FIG. 1, the armrest hardware 1 is attached to the wheelchair armrest tube 3 via an armrest clamp back 11 and an armrest clamp 21. As seen in more detail in FIG. 2, the armrest back clamp 11 has a radius surface 13 and a pair of apertures 15 through the armrest back clamp 11 on either side of the radius surface 13.

The armrest back clamp 11 mates with the armrest clamp 21 which is shown in more detail in FIG. 3. The armrest clamp 21 has a radius surface 23 that is similar to the radius surface 13 of the armrest clamp 11. On either side of the radius surface 23 are threaded apertures 25. Bolts 17, preferably socket head screws, are inserted through the apertures 13 in the armrest back clamp 11 and into the threaded apertures 25 of the armrest clamp 21 and tightened to clamp the armrest back clamp 11 to the armrest clamp 21 around a wheelchair armrest tube 3. The armrest hardware 1 can be moved along the armrest tube 3 to obtain a proper fit for the wheelchair occupant.

Referring again to FIG. 3, the armrest clamp 21 has a geared face 29 generally opposite the radius surface 23 and a central aperture 27. The geared face 29 of the armrest clamp 21 is attached to the geared face 49 of the depth adjustment bracket 41. As seen in FIG. 1, the geared face 29 of the armrest clamp 21 is attached to the geared face 49 of the depth adjustment bracket 41 using a toggle assembly 51. The toggle assembly 51 comprises a nut 53 and washer 55 used to secure the geared face 29 of the armrest clamp 21 to the geared face 49 of the depth adjustment bracket 41 by inserting the threaded stud 57 of the toggle assembly 51 through the aperture 47 in the geared face 49 of the depth adjustment bracket 41 and the aperture 27 in the geared face 29 of the armrest clamp 21. A spring 59 is used to bias the geared face 29 of the armrest clamp 21 away from the geared face 49 of the depth adjustment bracket 41. The toggle assembly 51 then provides a toggle 63 that, when disengaged, permits the spring 59 to bias the geared face 49 of the depth adjustment bracket 41 away from the geared face 29 of the armrest clamp 21 such that the angle of the depth adjustment bracket 41 can be changed relative to the wheelchair armrest tube 3, such as when it is desired to elevate the hand of a wheelchair occupant. Engaging the toggle switch 63 operates a cam 65, as shown in FIG. 1, in the toggle to effectively secure the depth adjustment bracket 41 to the armrest clamp 21 at the appropriate angle.

In order to accommodate the various wheelchairs on the market, many of which have varying diameter armrest tubes, the radius surface 13 of the armrest back clamp and the radius surface 23 of the armrest clamp 21 are designed with a "double hump" fixture that permits variance in the size of the wheelchair armrest tube 3.

As shown in FIG. 4, the depth adjustment bracket 41 is provided primarily to accommodate individuals of varying trunk sizes so that the armrest 9 can be positioned precisely for a particular user. As shown in more detail in FIG. 4, the geared face 49 of the depth adjustment bracket 41 gives way to a depth adjustment section 43 having a depth adjustment slot 45.

Figure 7:
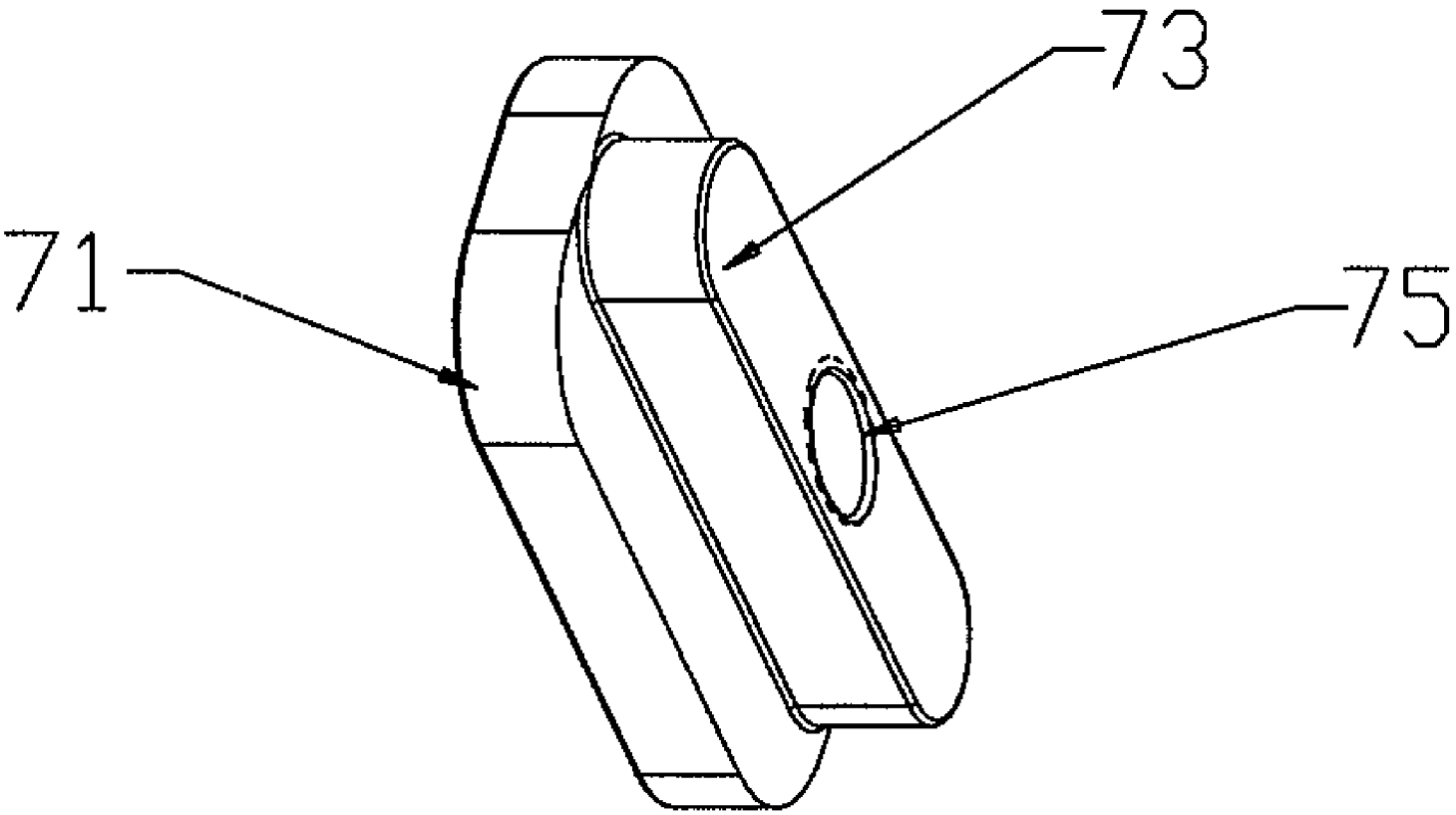
FIG. 7 is a top and side elevational view of the sliding nut used to attach the depth adjustment bracket to the angle adjustment base.
Figure 8:
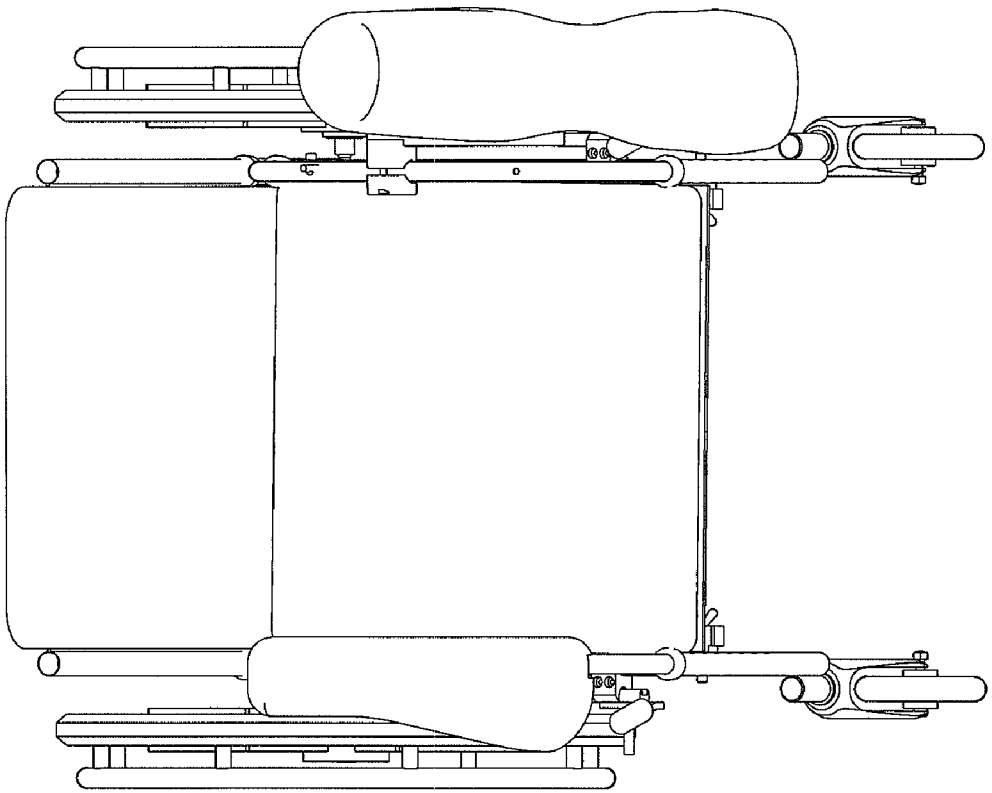
FIG. 8 is a top elevational view of an armrest attached via the apparatus of the claimed invention.
Figure 9:
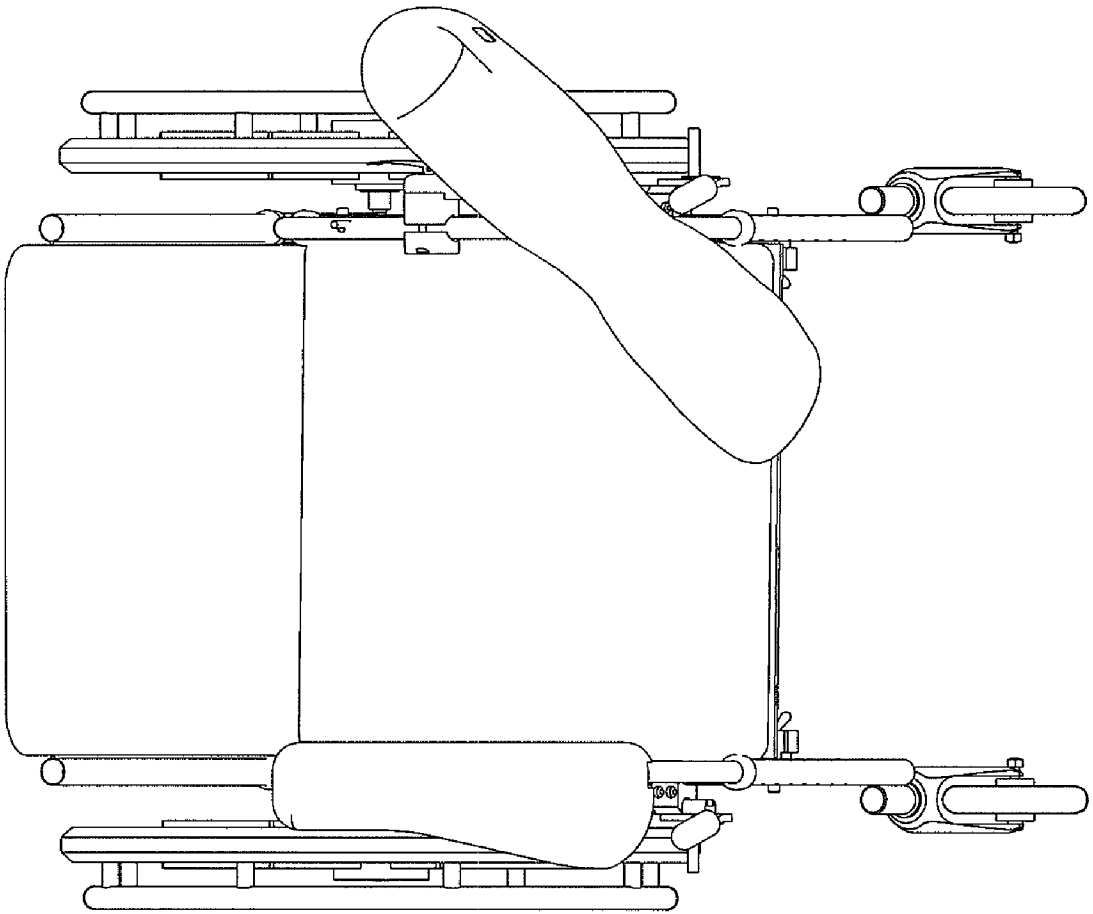
FIG. 9 is a top elevational view of an armrest attached via the apparatus of the claimed invention shown articulated inwardly.
Figure 10:
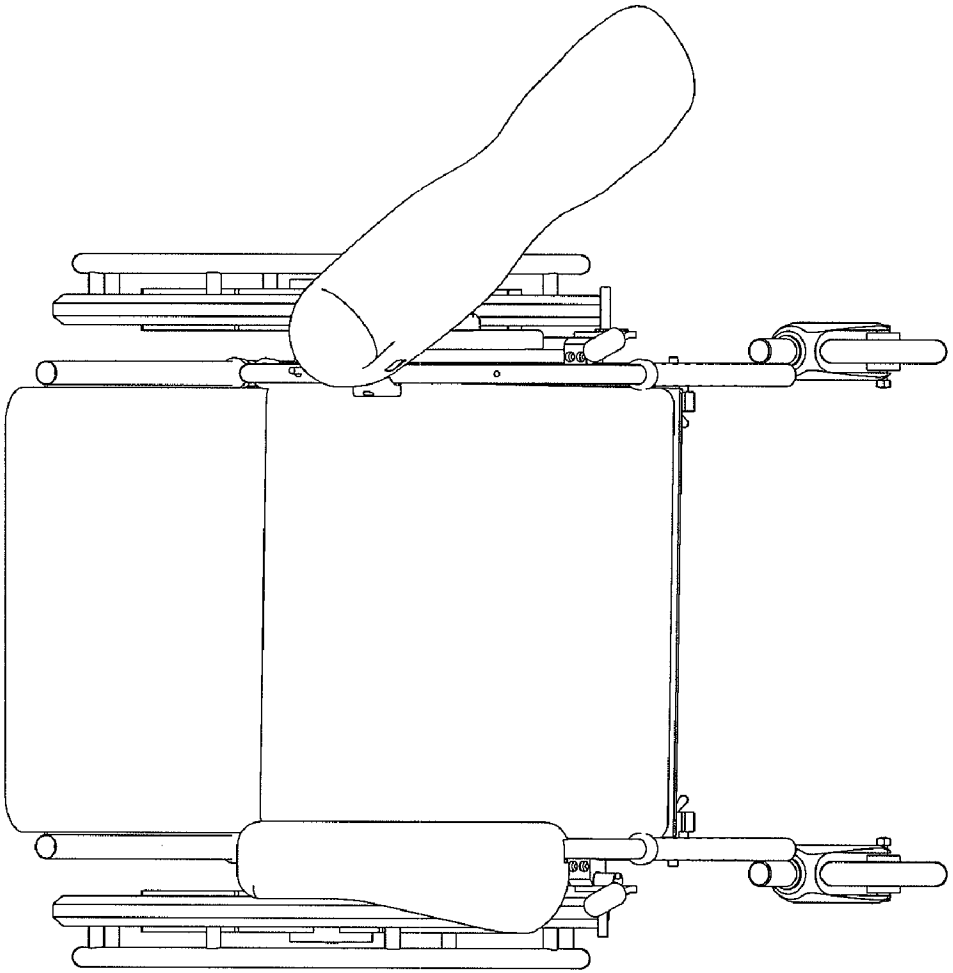
FIG. 10 is a top elevational view of an armrest attached via the apparatus of the claimed invention shown articulated outwardly.
Figure 11:
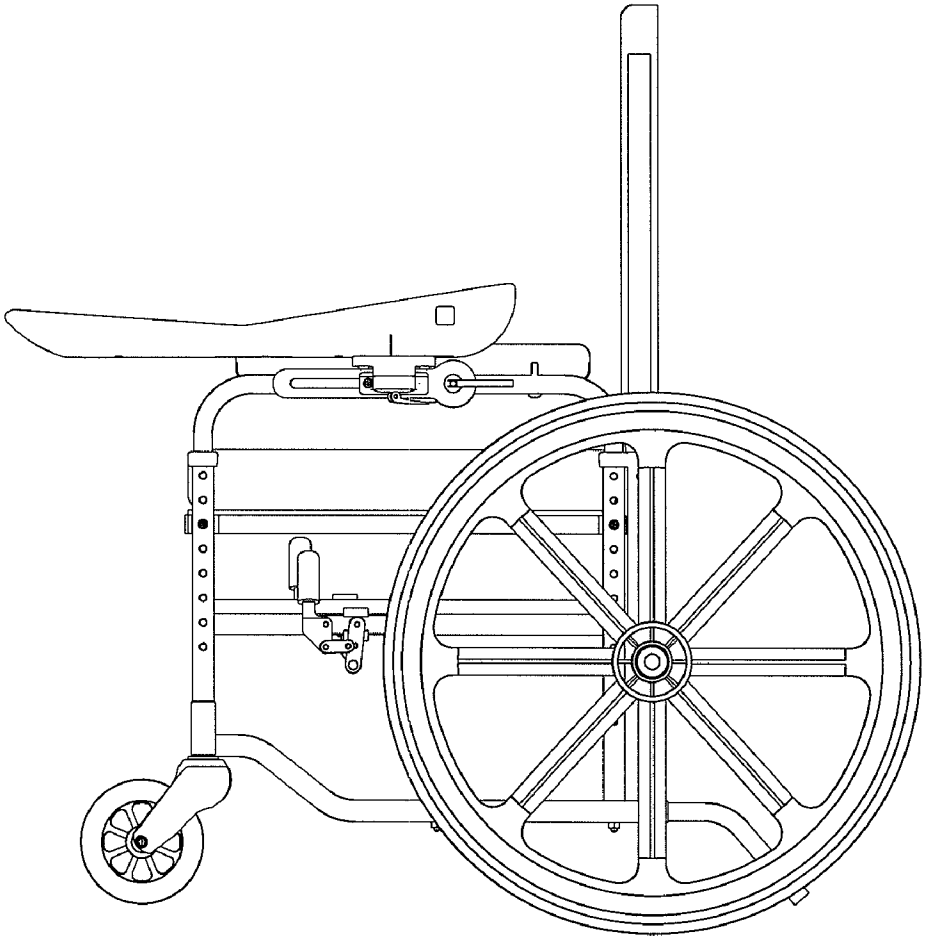
FIG. 11 is a side elevational view of an armrest attached via the apparatus of the claimed invention shown in its furthest retracted position.
Figure 12:
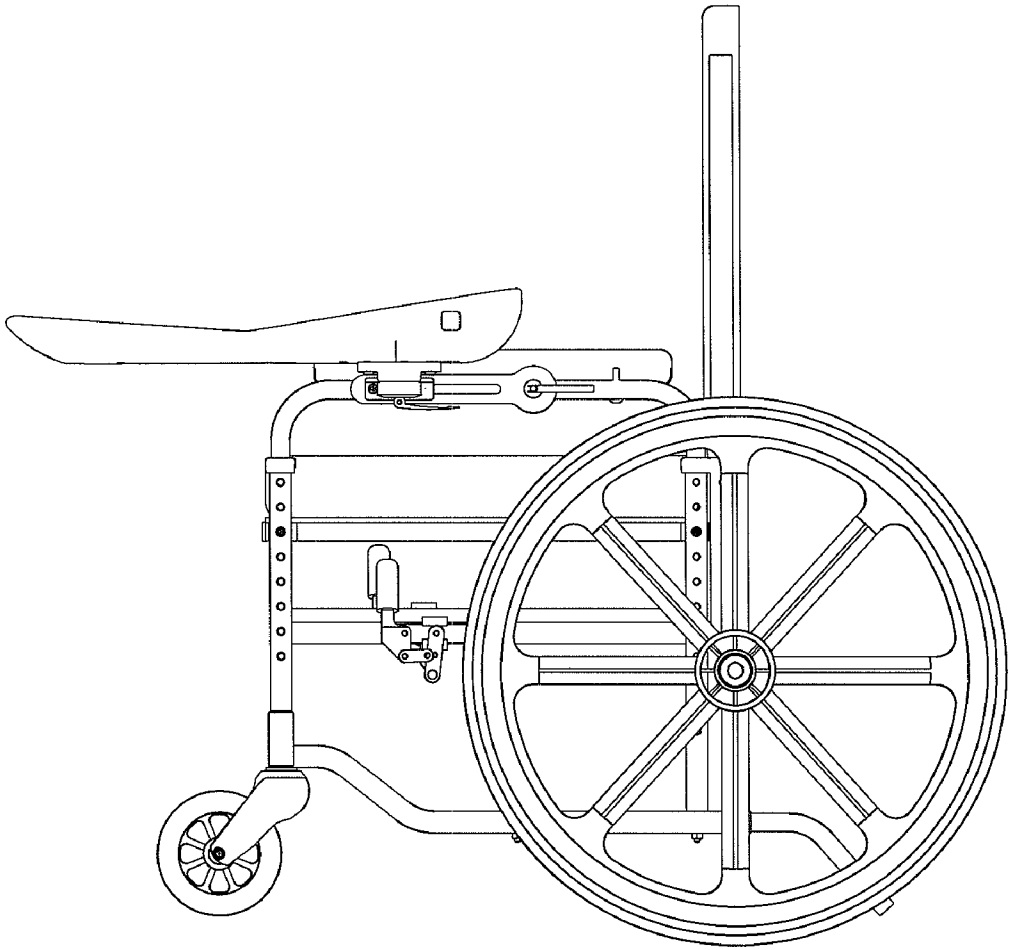
FIG. 12 is a side elevational view of an armrest attached via the apparatus of the claimed invention shown in its furthest forward position.
Figure 13:
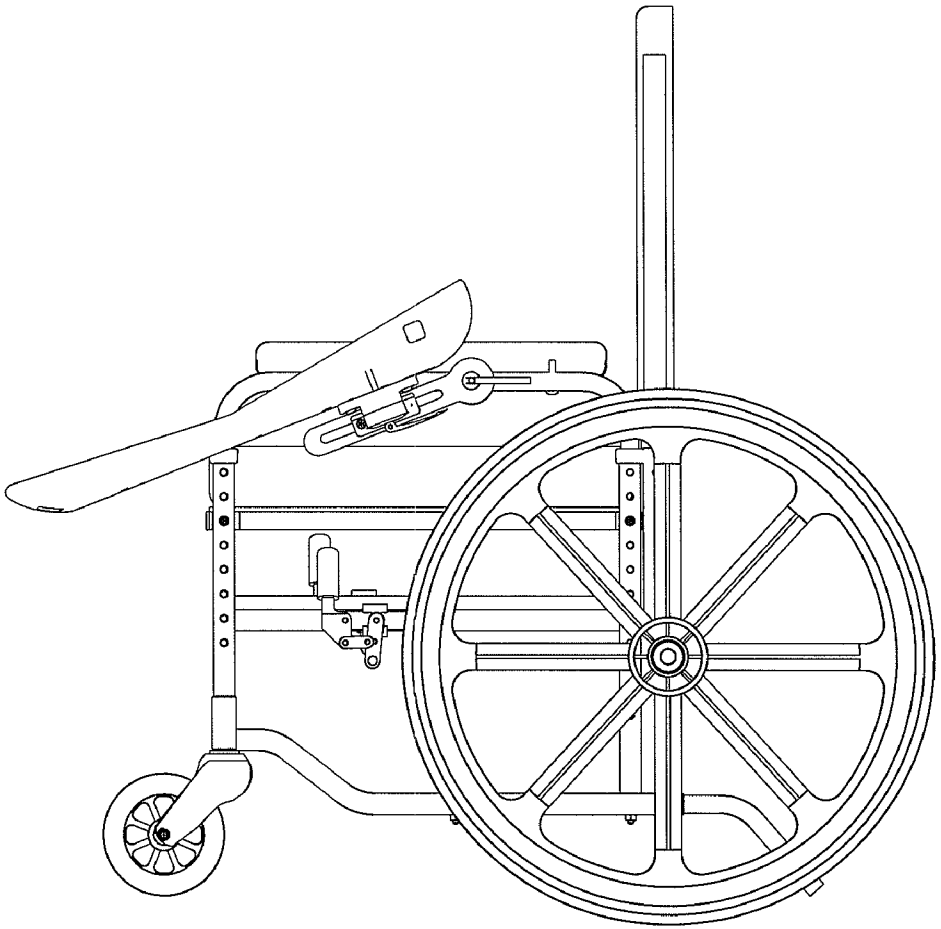
FIG. 13 is a side elevational view of an armrest attached via the apparatus of the claimed invention shown angled downwardly from the horizontal.
Figure 14:
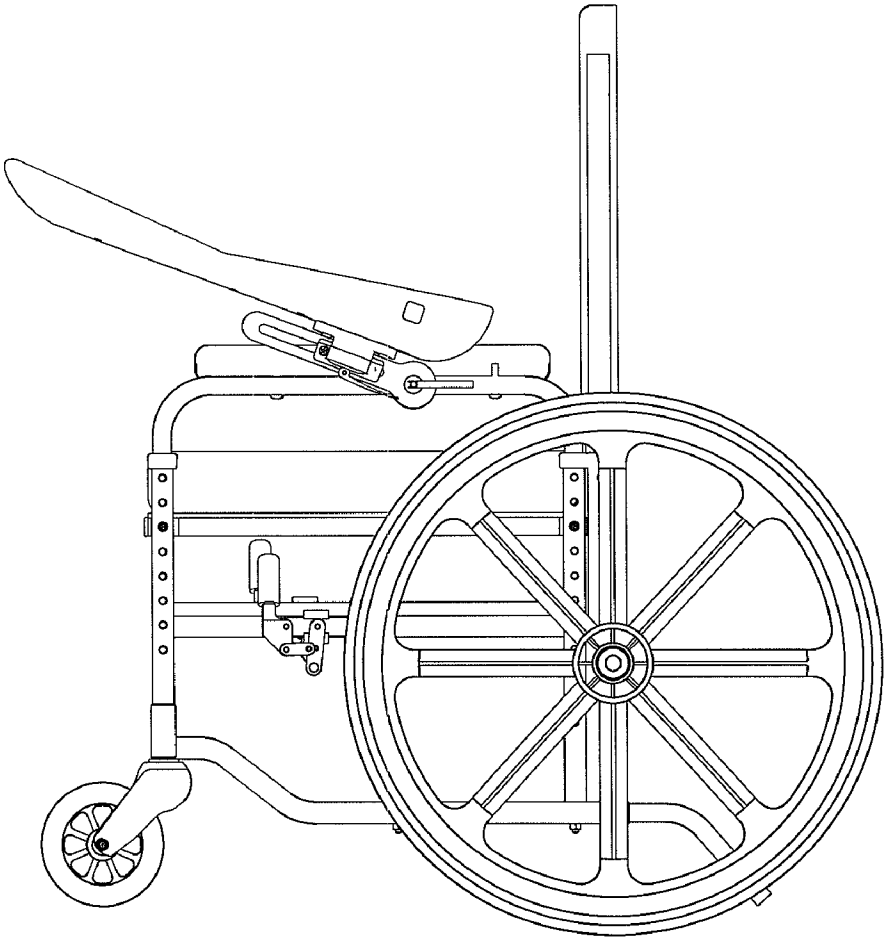
FIG. 14 is a side elevational view of an armrest attached via the apparatus of the claimed invention shown angled upwardly from the horizontal.

An angle adjustment base 81 is attached to the depth adjustment bracket 41 via sliding nut 71. As shown in FIG. 1, and in more detail in FIG. 7 the sliding nut 71 comprises a longitudinal ridge 73 and a threaded aperture 75. A bolt 77 is used to secure the angle adjustment base 71 to the sliding nut 71 via an aperture 82 in the angle adjustment base 81. Other attachment means are possible, but socket head cap screws are preferred. The longitudinal ridge 73 fits within the depth adjustment slot 45 on the depth adjustment bracket 41.

As seen in more detail in FIG. 5, the angle adjustment base 81 further comprises a geared face 83, the geared face having an aperture 85 therethrough. The geared face 83 of the angle adjustment base 81 interfaces with the geared face 93 of the angle adjustment bracket 91. As seen in more detail in FIG. 6, the angle adjustment bracket 91 comprises a geared face 93, the geared face 93 having an aperture 95 therethrough. The geared face 83 of the angle adjustment base 81 is attached to the geared face 93 of the angle adjustment bracket 91 via a toggle assembly 101 comprising a toggle 103, a threaded stud 105 attached to the toggle 103, a washer 107 and a nut 109. The threaded stud 105 is inserted through the aperture 85 in the angle adjustment base 81 and the aperture 95 in the angle adjustment bracket 91 and secured by the washer 107 and nut 109. A spring 106 is provided to bias the geared face 83 of the angle adjustment base 81 away from the geared face 93 of the angle adjustment bracket 91. As such, when the toggle 103 is engaged, it actuates the cam 111 to press the geared faces 83, 93 of the angle adjustment base 81 and the angle adjustment bracket 91 to secure them together at an appropriate angle. When the toggle 103 is disengaged, the spring 106 separates the geared faces 83, 93 enough such that angle adjustment of the armrest is possible.

Figure 6:
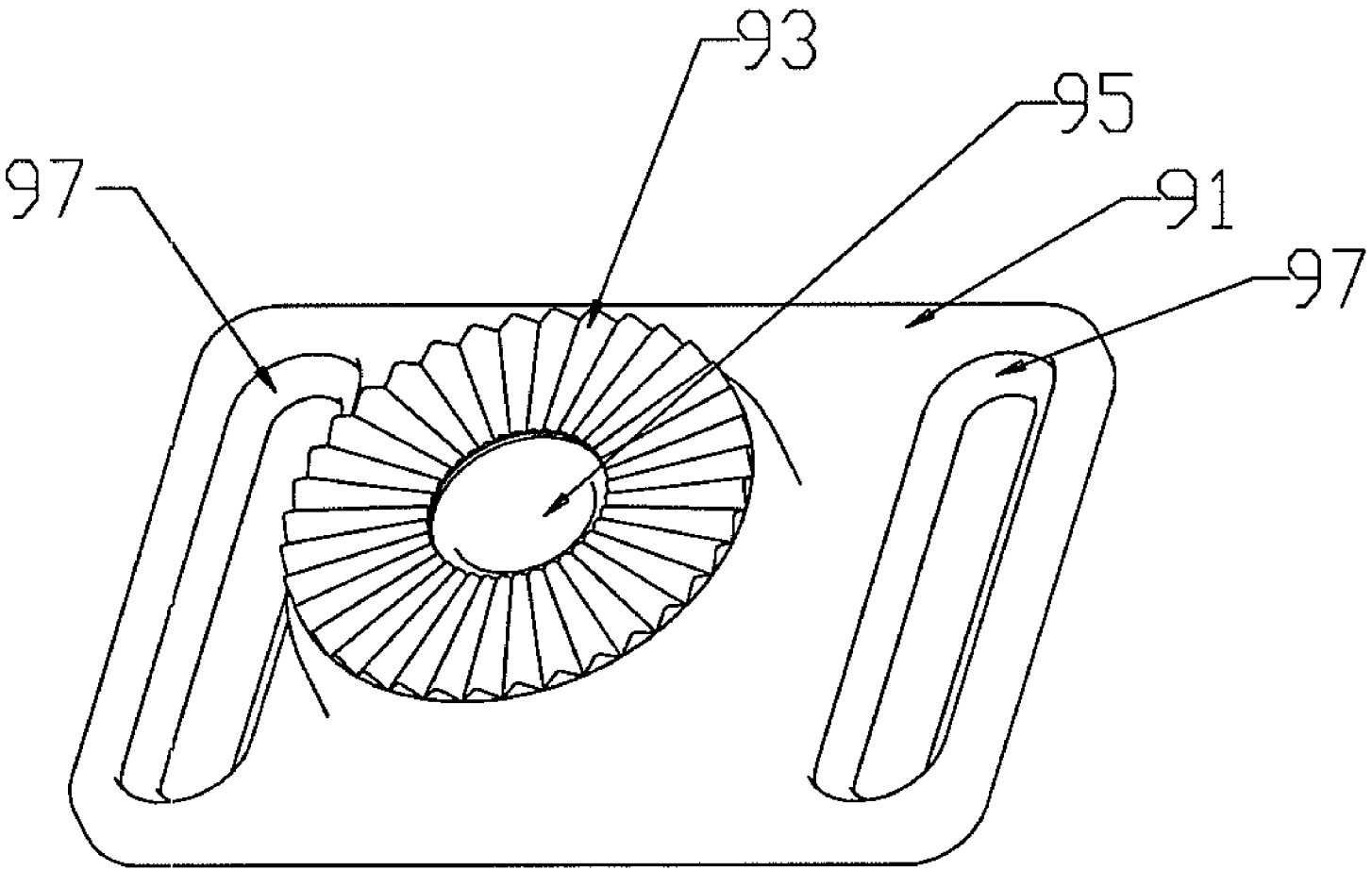
FIG. 6 is a top and side perspective view of the angle adjustment bracket.

Users of inventions such as that claimed herein come in a wide range of shapes and sizes and adjustability is a key concern. As seen in FIG. 6, the angle adjustment bracket 91 provides for adjustment in an additional dimension, that is, trunk width, in the form of width adjustment slots 97. The arm pad 9 is secured to the width adjustment slots 97 by a pair of bolts, preferably socket head cap screws (not shown), although other attachment means are possible.

Although I have very specifically described the preferred embodiments of the invention herein, it is to be understood that changes can be made to the improvements disclosed without departing from the scope of the invention. Therefore, it is to be understood that the scope of the invention is not to be overly limited by the specification and the drawings, but is to be determined by the broadest possible interpretation of the claims.

What is claimed is:

1. An apparatus for attaching an armrest pad to the armrest tube of a wheelchair comprising:

a clamp comprising an armrest back clamp and an armrest clamp, the armrest back clamp and an armrest clamp being designed for attachment to the armrest tube of a wheelchair, the armrest clamp further comprising a geared face having a central aperture;

a depth adjustment bracket comprising a first portion comprising a geared face fixable to the geared face of the clamp, the depth adjustment bracket providing angular adjustability of the depth adjustment bracket in relation to the clamp in the vertical plane, the depth adjustment bracket further comprising a second longitudinally extending portion further comprising a depth adjustment slot;

an angle adjustment base attachable along the second longitudinally extending portion of the depth adjustment bracket to provide depth adjustability, the angle adjustment base further providing a range of angular adjustability in the horizontal plane;

an angle adjustment bracket attached to the angle adjustment base; and an armrest pad attached to the angle adjustment base, the armrest pad being fixably positionable to support the wrist and forearm of a wheelchair occupant above the wheelchair occupant's elbow.

2. The apparatus of claim 1 wherein the geared face of the depth adjustment bracket is attached to the armrest clamp via a toggle assembly.

3. The apparatus of claim 2 wherein the toggle assembly is operable to permit rotation of the depth adjustment bracket relative to the armrest clamp when disengaged and to secure the depth adjustment bracket to the armrest clamp when engaged.

4. The apparatus of claim 1 wherein a sliding nut is used to secure the angle adjustment base within the depth adjustment slot of the depth adjustment bracket.

5. The apparatus of claim 4 wherein the angle adjustment base has a threaded aperture and a screw is inserted through an aperture in the sliding nut to secure the angle adjustment base to the sliding nut in the depth adjustment slot.

6. The apparatus of claim 5 wherein the depth adjustment slot permits approximately four inches of depth adjustability.

7. The apparatus of claim 1 wherein the angle adjustment bracket is secured to the angle adjustment base by a toggle assembly, the toggle assembly being operable to permit rotation when disengaged and to secure the angle adjustment bracket to the angle adjustment base when engaged.

8. The apparatus of claim 1 wherein the angle adjustment bracket further comprises a pair of width adjustment slots and the armrest is secured to the angle adjustment bracket by fasteners.

9. The apparatus of claim 8 wherein the width adjustment slot permits approximately two inches of width adjustability.

10. An elevating, articulating and depth adjustable device for attaching an armrest pad to the armrest tube of a wheelchair comprising:

an armrest back clamp having a pair of apertures therethrough;

an armrest clamp that is securable about the armrest tube of the wheelchair by a pair of fasteners through the apertures of the armrest back clamp, the armrest clamp further comprising a geared face having a central aperture;

a depth adjustment bracket comprising a geared face, the geared face being fixably attachable to the geared face of the armrest clamp and providing angular adjustability in the vertical plane and, the depth adjustment bracket further comprising a longitudinally extending portion, that longitudinally extending portion comprising a depth adjustment slot;

an angle adjustment base having a geared face, the angle adjustment base being attachable to the depth adjustment slot in the depth adjustment bracket and fixable along the depth adjustment slot so as to provide depth adjustability;

an angle adjustment bracket having a geared face, the geared face being removably attachable to the geared face of the angle adjustment base, the angle adjustment bracket being adjustable so as to provide articulation in the horizontal plane; and an armrest pad attached to the angle adjustment bracket; the armrest pad being configurable to support a wheelchair occupant's wrist above the wheelchair occupant's elbow.

11. The apparatus of claim 10 wherein the geared face of the depth adjustment bracket is attached to the geared face of the armrest clamp via a toggle assembly, the toggle assembly being operable to permit rotation when disengaged and to secure the depth adjustment bracket to the armrest clamp when engaged.

12. The apparatus of claim 10 wherein the angle adjustment bracket is secured to the angle adjustment base by a toggle assembly, the toggle assembly being operable to permit rotation when disengaged and to secure the angle adjustment bracket to the angle adjustment base when engaged.

13. The apparatus of claim 10 wherein the angle adjustment bracket further comprises a pair of width adjustment slots and the armrest is secured to the angle adjustment bracket by fasteners.

14. The apparatus of claim 13 wherein the width adjustment slot permit approximately two inches of width adjustability.

* * * * *